US006536878B2

(12) United States Patent
Kasperchik et al.

(10) Patent No.: US 6,536,878 B2
(45) Date of Patent: Mar. 25, 2003

(54) INK JET DROP GENERATOR AND INK COMPOSITION PRINTING SYSTEM FOR PRODUCING LOW INK DROP WEIGHT WITH HIGH FREQUENCY OPERATION

(75) Inventors: Vladek P. Kasperchik, Covallis, OR (US); Kenneth W. Peterson, Corvallis, OR (US); Todd A. Cleland, Corvallis, OR (US); Robert C. Maze, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/880,543

(22) Filed: Jun. 12, 2001

(65) Prior Publication Data

US 2002/0018103 A1 Feb. 14, 2002

Related U.S. Application Data

(63) Continuation of application No. 09/385,300, filed on Aug. 30, 1999, now Pat. No. 6,270,201, and a continuation-in-part of application No. 09/303,250, filed on Apr. 30, 1999, now Pat. No. 6,231,168.

(51) Int. Cl.[7] ..... B41J 2/05; B41J 2/17

(52) U.S. Cl. ..... 347/65; 347/94

(58) Field of Search ..... 347/63, 65, 94, 347/100, 67, 20, 56

(56) References Cited

U.S. PATENT DOCUMENTS

| | | | | |
|---|---|---|---|---|
| 5,169,437 A | * | 12/1992 | You | 347/100 |
| 5,785,743 A | * | 7/1998 | Adamic et al. | 347/100 |
| 5,793,393 A | * | 8/1998 | Coven | 347/65 |
| 6,309,052 B1 | * | 10/2001 | Prasad et al. | 347/57 |

* cited by examiner

*Primary Examiner*—John Barlow
*Assistant Examiner*—Juanita Stephens

(57) ABSTRACT

This present invention is embodied in a low-cost printing system including a printhead and an ink composition that provides photographic-quality resolution. The printhead of the present invention includes a high-density array of drop generators that eject ink drops having a low drop weight and that operate at a high frequency. Further, high-resistance firing resistors are used to provide minimum energy dissipation and the firing resistors are preferably thin-film resistors to ensure that a minimal amount of energy is needed to eject ink drops. The stability of the ink drop volume is maintained by including an overdamped structure within the ink drop generators that allow the ink chambers to fill up with ink slowly. The ink composition of the present invention includes an ink additive that prevents decel from occurring during sustained high-frequency printing bursts.

21 Claims, 11 Drawing Sheets

INK JET DROP GENERATOR AND INK COMPOSITION PRINTING SYSTEM FOR PRODUCING LOW INK DROP WEIGHT WITH HIGH FREQUENCY OPERATION

CROSS REFERENCE TO RELATED APPLICATIONS

This is a continuation of application Ser. No. 09/385,300 filed on Aug. 30, 1999, now U.S. Pat. No. 6,270,201, which is hereby incorporated by reference herein.

This application is a continuation-in-part of U.S. patent application Ser. No. 09/303,250, filed on Apr. 30, 1999, now U.S. Pat. No. 6,231,168, by Maze et al. and entitled "INK JET PRINTHEAD WITH FLOW CONTROL MANIFOLD SHAPE".

FIELD OF THE INVENTION

The present invention relates in general to ink jet printers and more specifically to a low-cost printing system including a novel printhead and ink composition that provides photographic-quality resolution output.

BACKGROUND OF THE INVENTION

Ink jet printers are popular and common in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Ink jet printers produce high-quality print, are compact and portable, and print quickly and quietly because only ink strikes a print medium (such as paper).

An ink jet printer produces a printed image by printing a pattern of individual dots (or pixels) at specific defined locations of an array. These dot locations, which are conveniently visualized as being small dots in a rectilinear array, are defined by the pattern being printed. The printing operation, therefore, can be pictured as the filling of a pattern of dot locations with dots of ink.

Ink jet printers print dots by ejecting a small volume of ink onto the print medium. These small ink drops are positioned on the print medium by a moving carriage that supports a printhead cartridge containing ink-drop generators. The carriage traverses over the print medium surface and positions the printhead cartridge depending on the pattern being printed. An ink supply, such as an ink reservoir, supplies ink to the drop generators. The drop generators are controlled by a microprocessor or other controller and eject ink drops at appropriate times upon command by the microprocessor. The timing of ink drop ejections typically corresponds to the pixel pattern of the image being printed.

In general, the drop generators eject ink drops through a nozzle or an orifice by rapidly heating a small volume of ink located within a vaporization or firing chamber. The vaporization of the ink drops typically is accomplished using an electric heater, such as a small thin-film (or firing) resistor. Ejection of an ink drop is achieved by passing an electric current through a selected firing resistor to superheat a thin layer of ink located within a selected firing chamber. This superheating causes an explosive vaporization of the thin layer of ink and an ink drop ejection through an associated nozzle of the printhead.

The resolution of an ink jet printer is directly related to the size and number of ink drops printed on a print medium. For example, for a given area a small number of large ink drops produces a relatively low-resolution printed image while a large number of small ink drops generally produces a higher-resolution printed image. The quality and resolution of printed images that a printer is capable of producing are often compared to photographs, and "photographic-quality" resolution means that the resolution approaches that of a photograph.

There is a continually increasing demand for low-cost ink jet printers that are capable of producing "photographic-quality" images. Achieving this high resolution while keeping costs low requires a careful balance between the architecture of the printhead (such as the architecture of the firing chamber, the firing resistor and the firing frequency) and the composition of liquid ink. Typically, a change in the printhead architecture or in the ink composition to solve one problem may create other problems. Thus, in order to produce an inexpensive ink jet printer capable of photographic-quality resolution several factors in the printhead architecture and ink composition should be taken into account.

For example, in order to produce photographic-quality resolution, an ink jet printer typically will use a printhead architecture that increases the number of drops per area (the dot resolution). This increased dot resolution generally is accomplished by greatly decreasing the size of each drop. However, one disadvantage of decreasing the drop size is that the speed of the printer is decreased because the area of print media covered by a single ink drop is also decreased.

Although this reduction in printer speed may be mitigated by increasing the number of drop generators in a given area (drop generator density) on a printhead, this creates other problems. In particular, an increase in the drop generator density means that the drop size must be reduced and the frequency of drops ejected (the firing frequency) increased. However, this reduction of drop size and increase in firing frequency creates a drop instability whereby the velocity and the volume of each drop has the undesirable characteristic of varying or decreasing over time. A decrease of drop velocity over time (during a single firing burst) is known as decel. Decel and other changes in drop velocity are undesirable because the accuracy of the drop placement on the print media is adversely affected.

As such, producing a low-cost ink jet printer capable of generating high-resolution printed output usually requires a careful balance between several factors. A change in printhead architecture that solves one problem may create other problems. Therefore, there exists a need for a low-cost ink jet printing system that provides high-resolution (such as photographic quality) output with a suitable printhead architecture and ink composition.

SUMMARY OF THE INVENTION

To overcome the limitations in the prior art as described above, and to overcome other limitations that will become apparent upon reading and understanding the present specification, the present invention is embodied in a low-cost printing system including a novel printhead architecture and ink composition that provides photographic-quality resolution output. The printhead architecture and ink composition of the present invention enables the manufacture of an inexpensive printing system that provides high-speed, photographic-quality printing.

The printhead architecture of the present invention includes a high-density array of drop generators that eject ink drops having a low drop weight. The speed of the printing system is maintained by operating the printing system at a high operating frequency. Power and thermal issues arising from operating a large array of drop generators at a high operating frequency are alleviated by lowering the energy dissipated from each firing resistor and the energy required by each firing resistor to eject an ink drop. In particular, high-resistance firing resistors are used to provide minimum energy dissipation and these firing resistors are preferably thin-film resistors to ensure that a minimal amount of energy is needed to eject ink drops. The stability of the ink drop volume is maintained by including an overdamped structure within the ink drop generators that allow the ink chambers to fill up with ink slowly.

The ink composition of the present invention includes an ink additive that prevents decel from occurring during sustained high-frequency printing bursts. This ink composition includes an aqueous vehicle and a decel-alleviating component that is capable of undergoing a rapid thermal decomposition upon heating. This combination of printhead architecture features and ink composition provides high-speed, high-resolution printing within a low-cost printing system.

Other aspects and advantages of the present invention as well as a more complete understanding thereof will become apparent from the following detailed description, taken in conjunction with the accompanying drawings, illustrating by way of example the principles of the invention. Moreover, it is intended that the scope of the invention be limited by the claims and not by the preceding summary or the following detailed description.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the present invention.

Referring now to the drawings in which like reference numbers represent corresponding parts throughout.

DETAILED DESCRIPTION OF THE PREFERRED EMBODIMENTS

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

Figure 1A:
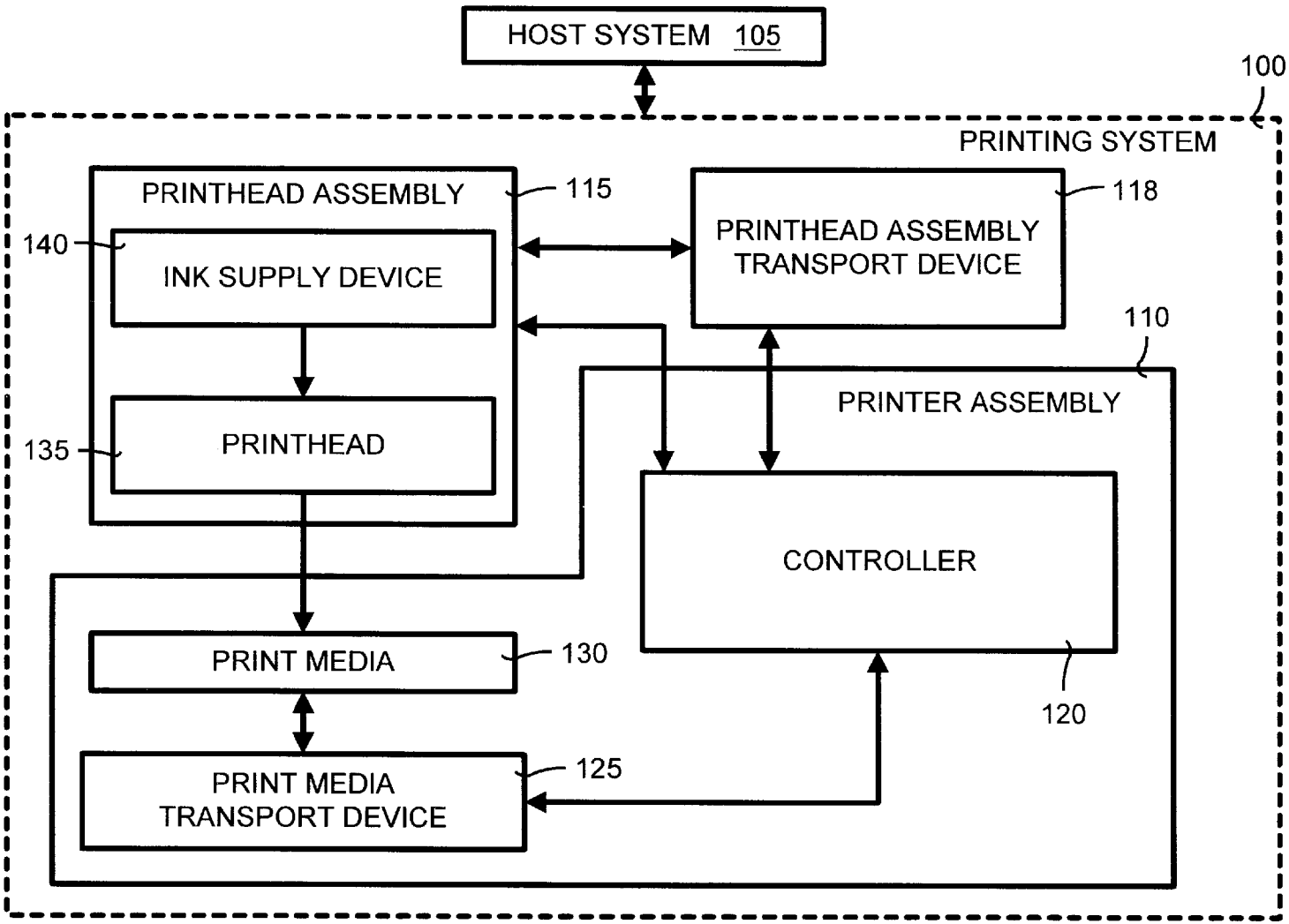
FIG. 1A is a block diagram of an overall printing system incorporating the present invention.

FIG. 1A is a block diagram of an overall printing system incorporating the present invention. The printing system 100 can be used for printing on any suitable material, such as paper media, transfer media, transparency media, photographic paper and the like. In general, the printing system communicates with a host system 105, which can be a computer or microprocessor that produces print data. The printing system 100 includes a printer assembly 110, which controls the printing system, a printhead assembly 115 that ejects ink and a printhead assembly transport device 118 that positions the printhead assembly 115 as required.

The printer assembly 110 includes a controller 120, a print media transport device 125 and a print media 130. The print media transport device 125 positions the print media 130 (such as paper) according the control instructions received from the controller 120. The controller 120 provides control instructions to the print media transport device 125, the printhead assembly 115 and the printhead assembly transport device 118 according to instructions received from various microprocessors within the printing system 100. In addition, the controller 120 receives the print data from the host system 105 and processes the print data into printer control information and image data. This printer control information and image data is used by the controller 120 to control the print media transport device 125, the printhead assembly 115 and the printhead assembly transport device 118. For example, the printhead assembly transport device 118 positions the printhead 135 over the print media 130 and the printhead 135 is instructed to eject ink drops according to the printer control information and image data.

The printhead assembly 115 is preferably supported by a printhead assembly transport device 118 that can position the printhead assembly 115 over the print media 130. Preferably, the printhead assembly 115 is capable of overlying any area of the print media 130 using the combination of the printhead assembly transport device 118 and the print media transport device 125. For example, the print media 130 may be a rectangular sheet of paper and the printhead assembly transport device 125 may position the paper in a media transport direction while the printhead assembly transport device 118 may position the printhead assembly 115 across the paper in a direction transverse to the media transport direction.

The printhead assembly 115 includes an ink supply device 140 that is fluidically coupled to the printhead 135 for selectively providing ink to the printhead 135. The printhead 135 includes a plurality of ink drop delivery systems, such as an array of ink jet nozzles or drop generators. As discussed further below, each ink drop delivery system forms a printed material by ejecting a drop of ink onto the print media 130 according to instructions from the controller 120.

Figure 1B:
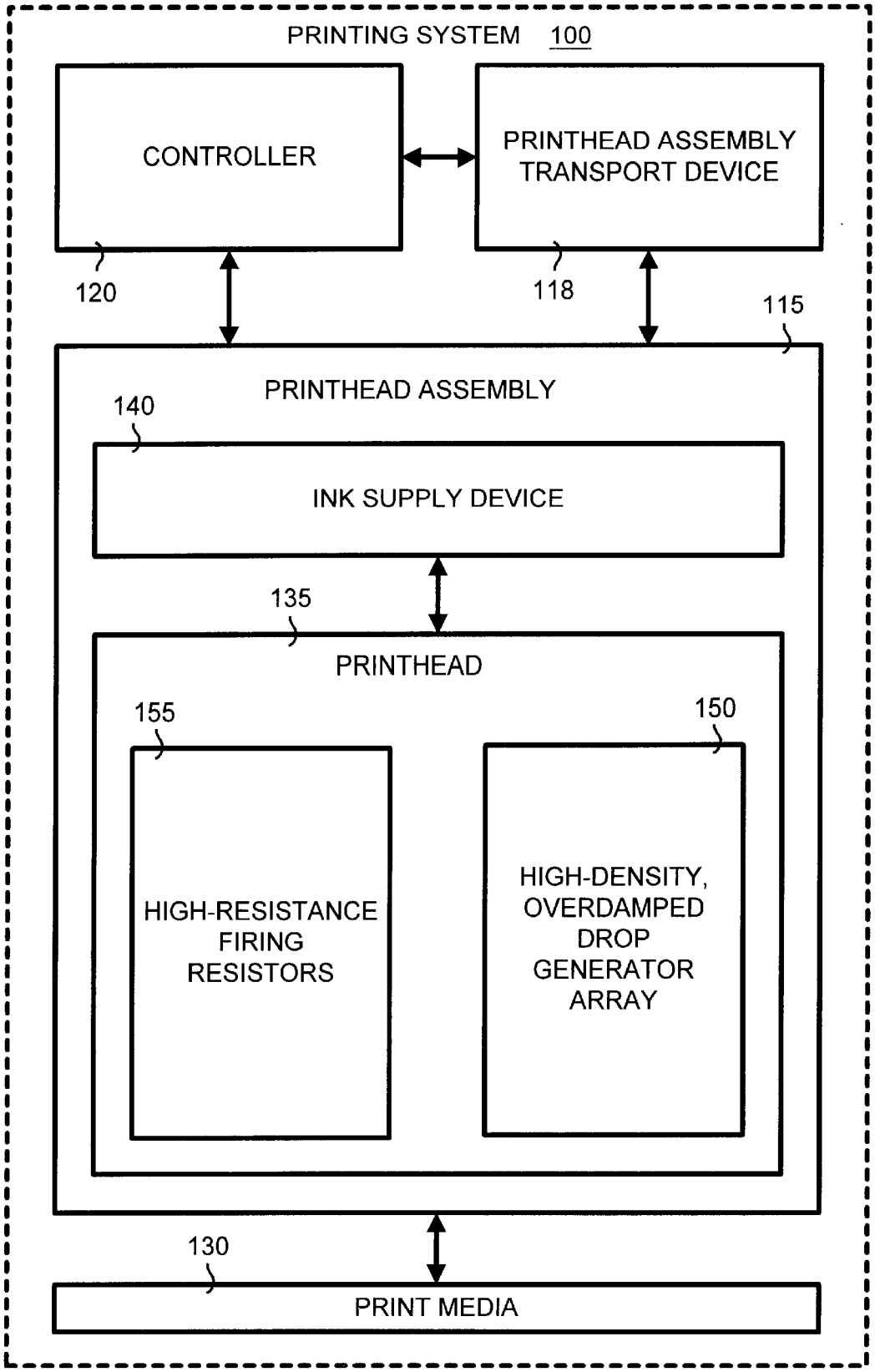
FIG. 1B is a block diagram of an overall printing system incorporating a preferred embodiment of the present invention.

FIG. 1B is a block diagram of an overall printing system incorporating a preferred embodiment of the present invention. The printhead assembly 115 includes an ink supply device 140 and a printhead 135. The printhead 135, which receives a supply of ink from the ink supply device 140, ejects ink onto the print media 130. The printhead assembly 115 is positioned over the print media 130 by the printhead assembly transport device 118 according to commands issued by the controller 120.

The printhead 135 comprises a high-density ink drop generator array 150 that actually contains the components for ejecting ink drops onto the print media 130. In addition, the printhead 135 includes a plurality of high-resistance firing resistors 155 that heat the ink from the ink supply device 140 and eject the ink. Energy to heat the firing resistors 155 is provided by a power supply (shown in FIG. 2B) and control of when the ink drops are fired is provided by the controller 120.

The printhead architecture and ink composition of the present invention provide reliable, low-cost, photographic-quality printing at high speed. High resolution print is achieved by having the ink drop generator array 150 eject ink drops of low weight. These low-weight ink drops provide a finer resolution because each individual drop is more difficult to see by the human eye. These low-weight ink drops also cover less area on the print media than higher-weight drops and, therefore, require more ink drop generators.

The present invention solves this problem by providing the high-density array of drop generators 150 that preferably contain twice the number of ink drop generators as existing printing systems. Manufacturing costs are reduced by using a standard-size substrate, thus permitting existing manufacturing tooling to be leveraged. This high-density drop generator array 150 along with a low-weight ink achieves a low-cost printing system 100 having high-resolution print.

The printing system 100 of the present invention uses a relatively high operating frequency. The controller 120 instructs the printhead 135 and the printhead assembly transport device 118 to operate at this high operating frequency. The result is an improved print speed even though the ink drop weight is small. One problem, however, with using a high operating frequency and low-weight ink drops is that the power required to maintain an acceptable print speed dramatically increases. Moreover, since the substrate size is constant the additional heat generated by this increased power must be dissipated within the same amount of substrate area. This can result in an adverse temperature rise in the printhead assembly 115.

This power issue is alleviated in the present invention by a combination of lowering parasitic energy dissipation from electrical leads of the firing resistors 155 and lowering the energy required to sufficiently activate the firing resistors 155 for ejecting ink drops. Lower parasitic energy dissipation is achieved by increasing the resistance of the firing resistors 155. These high-resistance firing resistors 155 preferably have a resistance of twice the resistance of comparable firing resistors, thereby reducing the energy dissipated by the firing resistors 155. Lowering the energy required to sufficiently activate resistors and fire ink drops is achieved using a more efficient thin-film structure of the firing resistors 155 of the present invention, as discussed below. The combination of reduced parasitic power dissipation and more efficient firing resistors provides the present invention with a high density, high frequency array of drop generators while eliminating unacceptable temperature excursions or rises occurring during operation of the printing system 100.

Stability of the ink drop ejection at high operating frequencies is affected by how well the ink drop generators of the ink drop generator array 150 fill with ink after each drop ejection. As explained below, if an ink flow channel within a drop generator is too underdamped, the ink refilling the firing chamber will slosh back and forth, causing the drop weight of ejected ink drops to vary unpredictably as the operating frequency varies. This is because some ink drops are ejected when the firing chamber contains more ink, resulting in larger drops, and some ink drops are ejected when the firing chamber contains less ink, resulting in smaller drops, with minimal ability to predict when these extremes will occur. The present invention uses an overdamped structure for each drop generator 150 that is designed to eliminate this sloshing or ringing effect so that ink drop weights can be better predicted and controlled.

Another stability issue that is addressed by the preferred embodiment of the present invention is decel. As stated above, decel is a decrease of drop velocity over time during a single firing burst. One preferred embodiment of the present invention addresses this instability by using an additive in the ink composition that greatly reduces the decel problem. Preferably, the ink contained within the ink supply device 140 contains the additive, which is explained in detail below. This combination of printhead architecture and ink composition allow the printing system 100 to achieve high-speed, high-resolution printing.

Exemplary Printing System

Figure 2A:
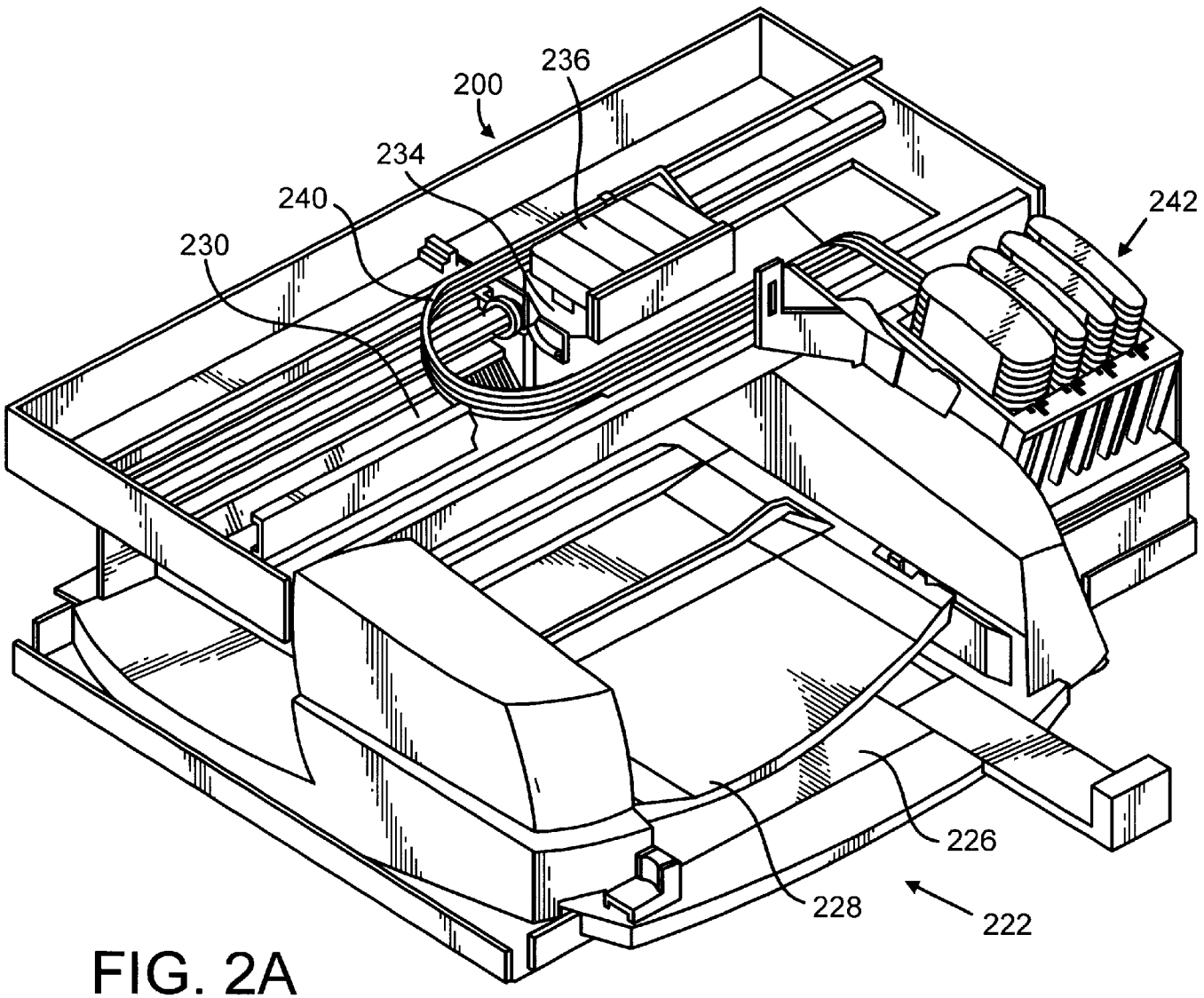
FIG. 2A is an exemplary printer that incorporates the present invention as is shown for illustrative purposes only.

FIG. 2A is an exemplary high-speed printing system that incorporates the present invention and is shown for illustrative purposes only. In general, the printer 200 can incorporate the printing system 100 of FIGS. 1A and 1B and further includes a tray 222 for holding print media. When a printing operation is initiated, the print media is transported into the printer 200 from the tray 222 preferably using a sheet feeder 226. The print media is then transported in a U-direction within the printer 200 and exits in the opposite direction of entry toward an output tray 228. Other print media paths, such as a straight paper path, can also be used.

Upon entrance into the printer 200 the print media is paused within a print zone 230 and a scanning carriage 234, which supports one or more printhead assemblies 236 (this is an example of printhead assembly 115 of FIGS. 1A and 1B), is then moved (or scanned) across the print media for printing a swath of ink drops thereon. The printhead assemblies 236 can be removeably mounted or permanently mounted to the scanning carriage 234. In addition, the printhead assemblies 236 can have self-contained ink reservoirs (for example, the ink reservoir can be located within the printhead body 304 of FIG. 3A) as the ink supply device 140 of FIGS. 1A and 1B. The self-contained ink reservoirs can be refilled with ink for reusing the printhead assemblies 236. Alternatively, each printhead assembly 236 can be fluidically coupled, via a flexible conduit 240, to one of a plurality of fixed or removable ink containers 242 acting as the ink supply device 140 of FIGS. 1A and 1B. As a further alternative, the ink supply device 140 can be one or more ink containers separate or separable from the printhead assemblies 236 and removeably mounted to the scanning carriage 234.

Figure 2B:
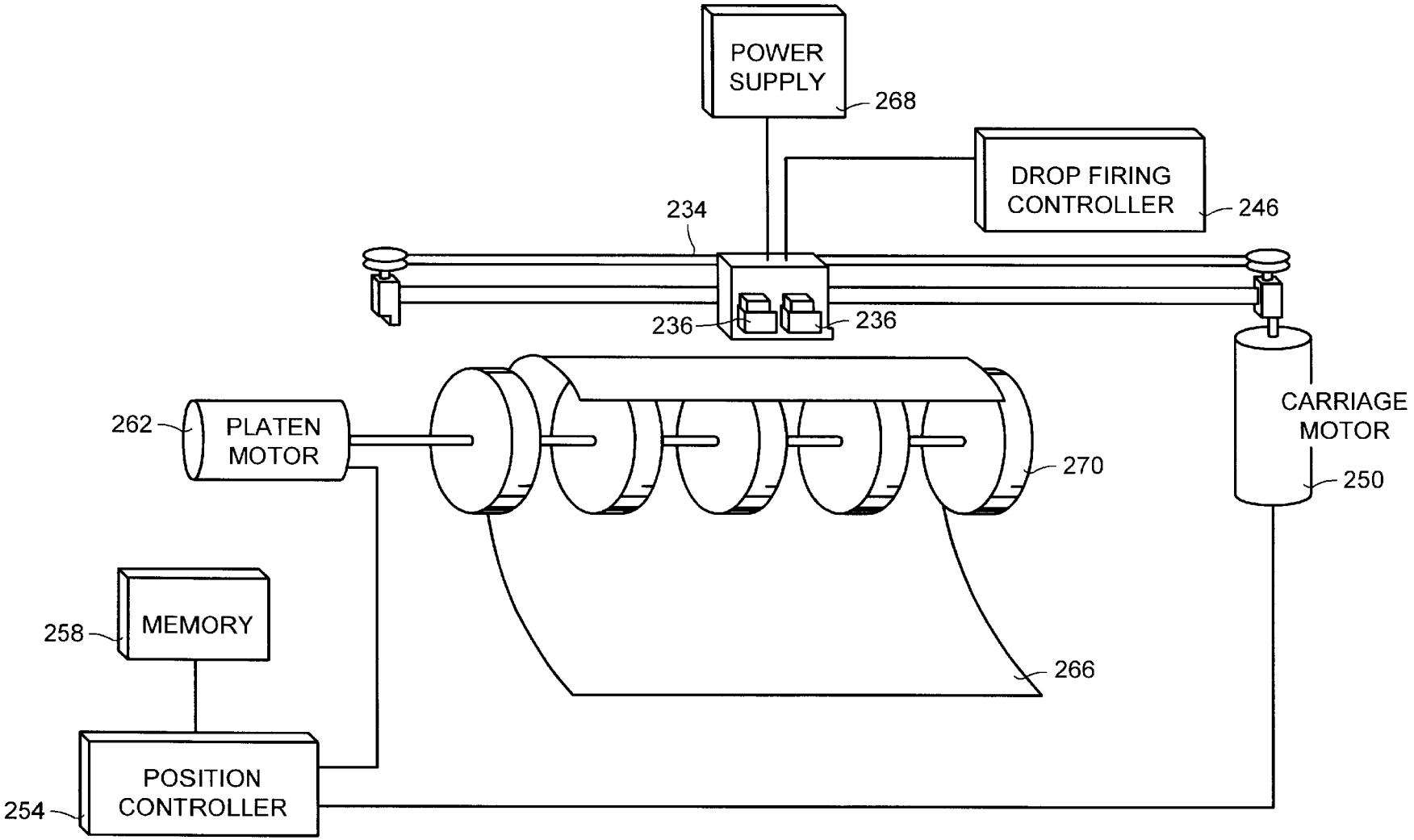
FIG. 2B is an exemplary scanning carriage that supports a printhead assembly of the present invention.

FIG. 2B is an exemplary scanning carriage that supports a printhead assembly of the present invention. The scanning carriage 234 supports the printhead assemblies 236, which may be removable or permanently mounted to the scanning carriage 234. A drop-firing controller 246 (that is in communication with controller 140 of FIGS. 1A and 1B) is coupled to the scanning carriage 234 that instructs the printhead assemblies 236 when to eject ink drops.

The scanning carriage 236 is moveable along a straight path direction. A carriage motor 250, such as stepper motor, transports the scanning carriage along the straight path according to commands from a position controller 254 (also in communication with controller 140). The position controller 254 is provided with memory 258 to enable the position controller 254 to easily find its position. The position controller 258 is coupled to a platen motor 262 (such as a stepper motor) that transports a print media 266 incrementally. The print media 266 is moved by pressure applied between the print media 266 and a platen 270. Electrical power to run the electrical components of the printing system 200 (such as the carriage motor 250 and the platen motor 262) as well as energy to cause the printhead assemblies 236 to eject ink drops is provided by a power supply 268.

A print operation occurs by feeding the print media 266 from the tray 222 and transported the print media 266 into the print zone 230 by rotating the platen motor 262 and thus the platen 270. When the print media 266 is positioned correctly in the print zone 230, the carriage motor 250 positions (or scans) the scanning carriage 234 and printhead assemblies 236 over the print media 266 for printing. After a single scan or multiple scans, the print media 266 is then incrementally shifted by the platen motor 262 thereby positioning another area of the print media 266 in the print zone 230. The scanning carriage 234 then again scans across the print media 266 for printing another swath of ink drops. The process is repeated until the desired print data has been printed on the print media 266 at which point the print media 266 is ejected into the output tray 228.

The present invention preferably uses sustained, high-frequency printing bursts to provide high-resolution printing using small ink drops. During such high-frequency printing bursts the scanning carriage 234 scans the printhead assemblies across the print media 266 while the printhead assemblies 236 eject ink drops in a grid pattern. Depending on the desired printing speed and the quality of the print the printhead assemblies 236 may cover an area of the print media 266 more than once, thus providing a degree of redundancy. The present invention achieves a high print speed by ejecting ink drops at a high frequency. This high frequency is needed because a high print speed is desired and because the printhead assemblies 236 of the present invention eject small ink drops (for higher resolution) and the area covered by a single ink drop is less than for a larger ink drop. This sustained, high-frequency printing causes severe thermal and other stability-related problems that need to be addressed. As described in detail below, the present invention addresses and solves these problems in an efficient and cost-effective manner.

The sustained, high-frequency printing bursts of the present invention may also be used with alternative printing systems (not shown) that utilize alternative media and printhead assembly transport mechanisms, such as those mechanisms incorporating grit wheel, roll feed or drum technology to support and move the print media 266 relative to the scanning carriage 234 and printhead assemblies 236. With a grit wheel design, a grit wheel and pinch roller move the print media 266 back and forth along one axis while a carriage carrying one or more printhead assemblies scans past the print media 266 along an orthogonal axis. With a drum printer design, the print media 266 is mounted to a rotating drum that is rotated along one axis while a carriage carrying one or more printhead assemblies scans past the print media 266 along an orthogonal axis. In either the drum or grit wheel designs, the scanning is typically not done in a back and forth manner as is the case for the system depicted in FIGS. 2A and 2B.

II. Printhead Architecture

One aspect of the present invention is that it can be implemented as a low-cost, high-resolution printing system including a novel printhead architecture and ink composition. In particular, an exemplary embodiment of the present invention uses a high-density array of drop generators operating at a high frequency and ejecting ink drops having a low drop weight. The high-density array of drop generators is disposed on a standard size substrate that mitigates the expense of retooling manufacturing equipment. Further, the printhead architecture includes high-resistance resistors that provide a low-power dissipation and a thin-film resistor structure that requires minimum energy to cause an ink drop to be ejected. Stability of the ink drop is greatly enhanced by providing a drop generator with an underdamped structural design so that drop volume is nearly constant. This combination of printhead architecture and ink composition (discussed below) enables an exemplary embodiment of the present invention to achieve high-speed, photographic-quality printing at a reduced cost.

Figure 3B:
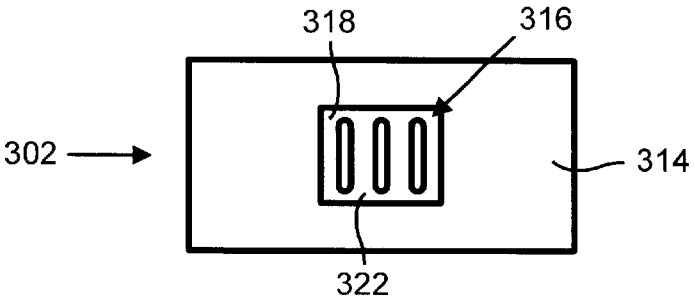
FIG. 3B illustrates the thermal ink jet head assembly of FIG. 3A.
Figure 3A:
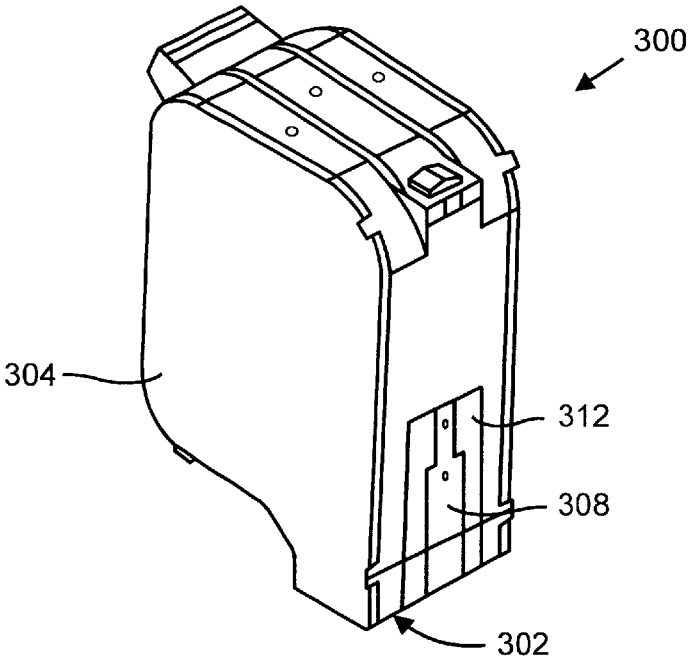
FIG. 3A shows for illustrative purposes only a perspective view of an exemplary print assembly incorporating the present invention.

FIG. 3A shows for illustrative purposes only a perspective view of an exemplary print assembly 300 (an example of the printhead assembly 115 of FIGS. 1A and 1B) incorporating the present invention. A detailed description of the present invention follows with reference to a typical printhead assembly used with a typical printer, such as printer 200 of FIG. 2A. However, the present invention can be incorporated in any printhead and printer configuration. Referring to FIGS. 1A, 1B and 2A along with FIG. 3A, the printhead assembly 300 is comprised of a thermal ink jet head assembly 302 and a printhead body 304. The thermal ink jet head assembly 302 can be a flexible material commonly referred to as a Tape Automated Bonding (TAB) assembly and can contain interconnect pads 312. The interconnect pads 312 are suitably secured to the printhead assembly 300 (also called a print cartridge), for example, by an adhesive material. The contact pads 308 align with and electrically contact electrodes (not shown) on the scanning carriage 234 of FIGS. 2A and 2B.

FIG. 3B illustrates the thermal ink jet head assembly 302 that includes a printhead 314 and a nozzle member 316. The nozzle member 316 preferably contains plural orifices or nozzles 318, which can be created by, for example, laser ablation or electroforming, for creating ink drop generation on a print media. Fluidically coupled to the nozzle member 318 and preferably underlying the nozzle member is a high-density array of ink drop generators 322. This array of ink drop generators 322 includes a plurality of high-resistance firing resistors (not shown) that require a minimum of energy to eject an ink drop from the nozzle member 318.

Low Ink Drop Weight

High-resolution print (such as photographic-quality resolution) can be achieved in part by having the ink drop generators 322 eject ink drops having a low drop weight. A low-weight drop is smaller and provides a finer resolution print than is achieved with higher-weight drops. One disadvantage, however, with a low-weight drop is that, because the ink drop covers a smaller area on the print media, more ink drop generators are required to maintain the speed of the printing system at an acceptable level. As discussed below, the present invention uses a high-density array of drop generators 322 to maintain a high print speed while using low-weight ink drops.

In a working example of the present invention, each ink drop weighs less than 8 nanograms (ng), with a preferred drop weight of approximately 5 ng and a range of 3.5 ng to 6.5 ng achieving the highest photographic-quality print. Lower drop weights, however, may be utilized with the present invention.

High-Density Array of Drop Generators

Lower drops weights mean that more drops are needed to cover the same amount of print media area. The present invention addresses this concern by providing a high-density array of drop generators. This high-density array of drop generators is disposed on a standard-size substrate on the printhead assembly and each drop generator is capable of ejecting a low-weight ink drop. The standard-size substrate means that existing manufacturing tooling can be used, eliminating the need for expensive retooling.

Each drop generator within the array has an ejection orifice (such as a nozzle) through which an ink drop is ejected. Further, each drop generator has at least one firing resistor for heating the ink within the firing chamber enough to vaporize the ink and eject an ink drop. These firing resistors are arranged in groups (also called primitives). Preferably, ground connections are shared between primitives so that more than one primitive is connected to the same ground line. Further in a preferred embodiment, groups of at least 4 primitives share the same ground line. This helps reduce the number of required electrical interconnections to the printhead.

Figure 4D:
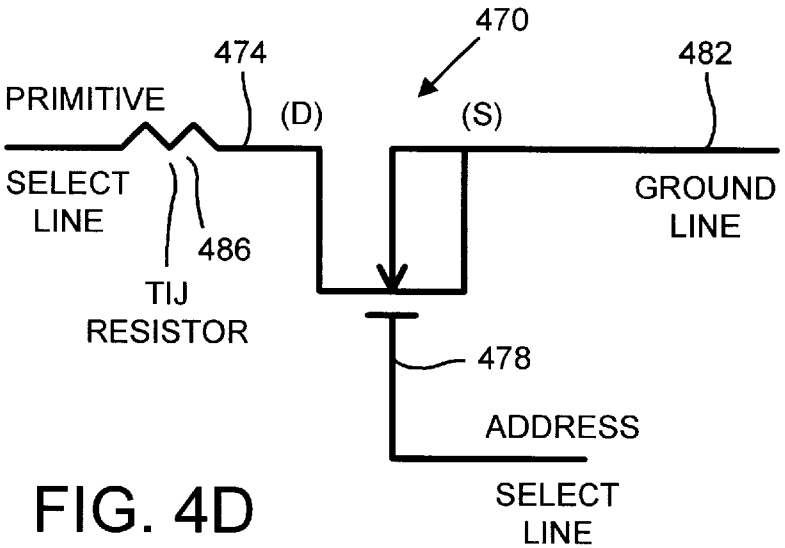
FIG. 4D is a schematic of a plurality of primitives wired to a common ground.
Figure 4B:
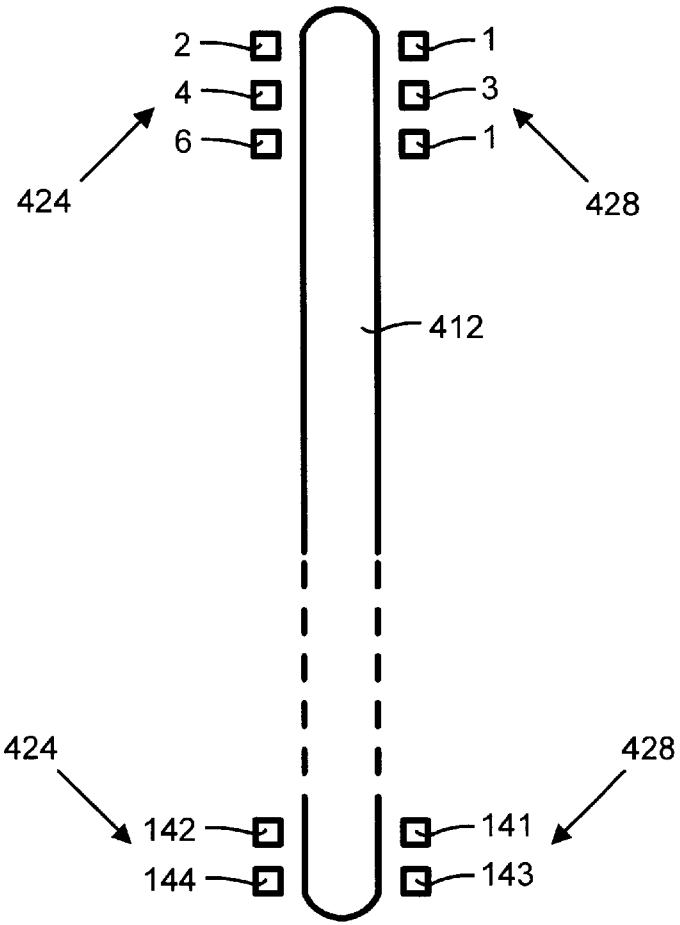
FIG. 4B is a detailed view of the printhead of FIG. 4A illustrating the nozzle arrangement.
Figure 4A:
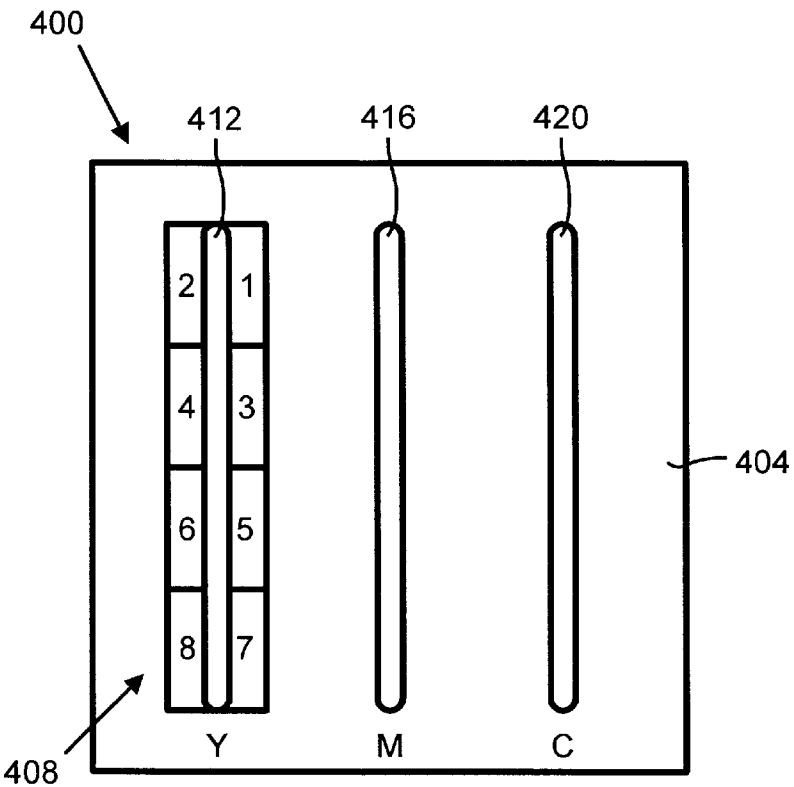
FIG. 4A is a plan view and working example of the printhead of the present invention.

FIG. 4A is a plan view and working example of the printhead of the present invention. The printhead 400 (an example of printhead 314 of FIGS. 3A and 3B) includes a substrate 404 upon which are located a plurality of ink drop generators (not shown). In this example, the substrate 404 is a standard size of approximately 7.9 by 8.7 millimeters. The substrate 404 has a plurality of ink feed slots carrying ink to rows of firing resistors 408 arranged adjacent the ink feed slots. Each ink feed slot carries a certain ink color, and, in this example, the ink feed slots are a yellow ink feed slot 412, a magenta ink feed slot 416 and a cyan ink feed slot 420. Alternatively, other colors including black ink may be used.

In this working example the substrate 404 has 432 drop generators corresponding to 432 firing resistors with 144 drop generators and firing resistors with a substantially linear arrangement of 72 drop generators along each side of the three ink feed slots. For example, referring to FIG. 4B, the yellow ink feed slot 412 contains even-numbered firing resistors 424 (2 to 144) on one side of the ink feed slot 412 and odd-numbered firing resistors 428 (1 to 143) on the other side of the slot 412, for a total of 144 firing resistors in a staggered arrangement. Overall, the substrate 404 has a drop generator density of at least 6 firing resistors per square millimeter.

Figure 4C:
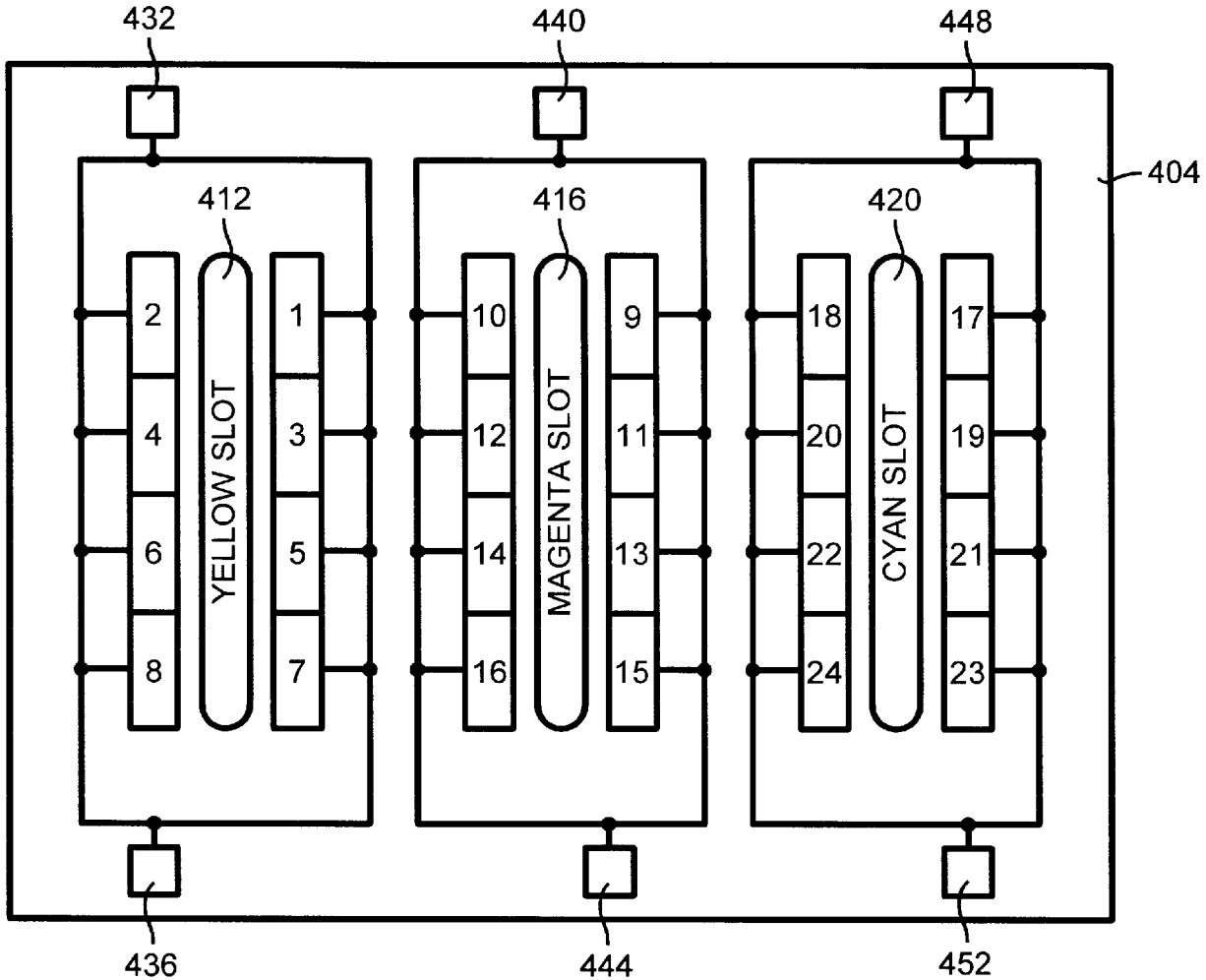
FIG. 4C is a detailed view of the printhead of FIG. 4A illustrating the sharing of a common ground among the primitives.

Referring to FIG. 4C, the firing resistors are grouped into 24 primitives based upon firing order (as explained below) with each primitive containing 18 firing resistors. The primitives are numbered from 1 to 8 about the yellow ink feed slot 412.

In addition, primitives 9 to 18 and 19 to 24 are arranged around the magenta ink feed slot 416 and the cyan ink feed slot 420, respectively. Each grouping of eight primitives around each ink feed slot share a single ground line that has connections along opposing edges of the substrate. For example, primitives 1 to 8 share common ground lines 432 and 436, primitives 9 to 18 share common ground lines 440 and 444, and primitives 19 to 24 share common ground lines 448 and 452.

Routing each ground line to the opposing edges of the substrate 404 helps reduce variations in parasitic resistance. This reduction in parasitic resistance occurs between primitives toward the middle of the substrate 404 (such as primitives 3, 4, 5, and 6) as compared to primitives toward the edge of the substrate 404 (such as primitives 1,2, 7 and 8).

As mentioned above, the firing resistors are grouped into primitives based upon firing order. This grouping is accomplished by coupling each resistor to a separate switching device that controls a flow of current through the resistor. Each switching device has input connections that are energized or selected to allow the switching device to pass current through the resistor. Input connections to these switching devices are shared among multiple switching devices, allowing for multiplexing. This multiplexing allows the number of input connections to be considerably less than the number of firing resistors.

Referring to a working example of FIG. 4D, each switching device is a transistor 470. The transistor 470 has a primitive select line 474, a address select line 478 and a ground line connection 482. To operate a firing resistor 486, the address select line 478 is activated, which allows current to pass through the transistor 470. While the address select line 478 is activated, the primitive select line 474 is activated concurrently and sufficient current is passed between the primitive select line 474 and the ground line 482 to fire the firing resistor 486.

Each primitive has its own separate primitive select line (such as primitive select line 474) that is coupled to all of the resistors within the primitive (such as firing resistor 486). Further, each resistor in the primitive has a different address select line (such as address select line 478) to allow selective activation of each firing resistor and each address select line is connected to transistors in multiple primitives. In one embodiment, each address select line is coupled to one of the transistors in every primitive. In another embodiment, each address select line is coupled only to some of the primitives. While operating the printhead, the address select lines are activated sequentially so that only a single firing resistor in a primitive is actuated at a time.

Although each primitive has a separate primitive select line, providing each primitive with an independent ground line would result in an excessive number of pad connections around the printhead. Thus, to reduce the required number of connections multiple primitives share a common ground line. In a preferred embodiment, at least 4 primitives share a common ground line. One problem, however, is that at a high operating frequency the ground lines carry a high current resulting in parasitic energy losses. As discussed further below, the present invention reduces this high current to achieve high performance operation by employing high resistance resistors.

It should be noted that FIGS. 4A–4D illustrate an exemplary example of the printhead of the present invention. Alternatively, other printhead architectures can be used that incorporate the present invention. For example, a greater or lesser number of ink drop generators can be utilized and the grouping of primitives can vary from those set forth in the above example.

High Operating Frequency

In general, the ink drop generators of the present invention are required to operate at a high operating frequency in order to maintain an acceptable print speed while using low weight ink drops. Preferably, this operating frequency in the kilohertz (KHz) range. This high operating frequency combined with the high-density array of drop generators provides improved print speed at high resolution.

In a working example, the ink drop generators have been operated at frequencies ranging from 2.25 to 18 KHz. Preferably, the ink drop generators operate at 18 KHz in bi-directional printing with an ink drop weight of approximately 5 ng. At this high frequency and low drop weight there are increased power requirements for ejecting the ink drops. For example, when the drop weight is reduced from 10 ng to 5 ng the power required for a conventional resistor drops only about 15%. If the number of resistors is doubled, as in this working example, it can be seen that the power required to energize the resistors is greatly increased.

High-Resistance/Low-Power Resistors

The present invention includes a thin-film resistor structure that decreases the power requirement for each resistor. In particular, the present invention uses a unique resistor structure to reduce the power required to energize the resistor and reduce the input power dissipated due to parasitic energy dissipation. Both resistor structures facilitate using high-frequency printing bursts in the printing system by reducing the power requirements of the printhead and eliminating a major increase in thermal energy due to an increased power requirement. In other words, reducing the power requirement enable less power to be used by the printhead even though there are more resistors, thereby allowing the printhead to operate at a lower temperature.

Figure 5:
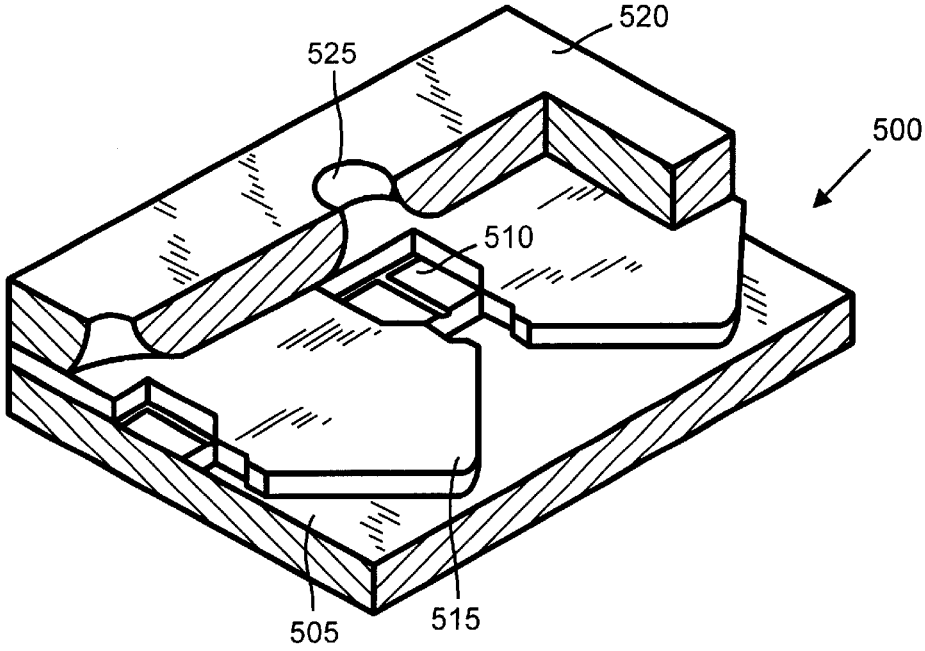
FIG. 5 is a cut-away perspective view of an exemplary drop generator of the present invention.

In particular, FIG. 5 is a cut-away perspective view of an exemplary drop generator including a thin-film resistor. The drop generator 500 is disposed on a substrate 505 and includes a thin-film resistor structure 510 (shown in greater detail in FIGS. 6A and 6B). Overlying the resistor structure 510 is a barrier layer 515 and an orifice layer 520, both discussed further below. The top of the thin-film resistor structure 510 and the barrier and orifice layers 515, 520 form a firing chamber where ink is vaporized by the resistor structure 510 and ejected through an orifice 525 (such as a nozzle). Preferably, the orifice diameter is within a range of between about 10 to 15 microns, with an exemplary value of 12.6 microns. Each component and layer of the drop generator 500 may be formed separately or integrally and various methods for forming these components and layers are known in the art. For example, the barrier and orifice layers can be applied separately or formed integrally and then applied to the underlying substrate layer.

The first resistor structure of the present invention increases the resistance of the firing resistors so that the ratio of connecting trace resistance (or parasitic resistance) to total resistance, known as "parasitic power loss", is decreased. Each resistor has connecting traces that connect the resistor to various electrical connections. In conventional designs, the resistance of the connecting traces may be up to one-third or greater of the firing resistor resistance. This parasitic power loss can cause up to one-third of the input energy to be dissipated within the connecting traces. Parasitic power loss becomes even more significant as the number of resistors per unit area (resistor density) increases, since there is less room for the connecting traces and a greater total power requirement.

The present invention decreases the parasitic power loss by increasing the resistance of each firing resistor thereby decreasing the power dissipated within the connecting traces. Preferably, the resistance of each firing resistor is at least 70 ohms with a preferred value of over 100 ohms. Higher resistance can be achieved by reducing the thickness of the resistor or by using a resistor material of higher resistivity. In a preferred embodiment of the present invention, however, the thickness of the resistor and resistivity of the resistor material are unchanged and the resistor path length is increased to obtain a higher resistance. This is achieved by splitting the resistor body into a plurality of segments that are connected in series by a coupling device or conducting link. This split resistor increases the resistance of the firing resistor because the resistance of each segment is added to the previous segment in the series. An increase in the resistor resistance also increases the total resistance (while keeping the connecting trace resistance nearly constant) and thereby decreases the parasitic power loss (the ratio of trace resistance to the total resistance).

Figure 6A:
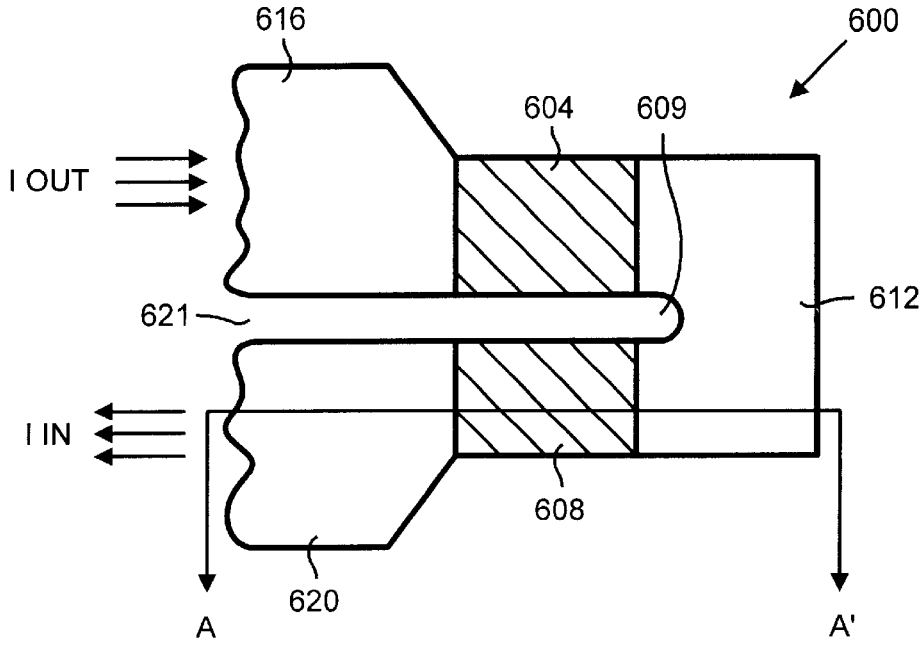
FIG. 6A is a plan view of a firing resistor of the present invention.

FIG. 6A is a plan view of a firing resistor of the present invention. In this working example, the firing resistor 600 comprises a first segment 604 and a second segment 608 that are connected in series by a coupling device or conductor 612. An input pad 616 for receiving electrical signals is located adjacent the first segment 604 and an output pad 620 for transmitting electrical signals is located adjacent the second segment 608. In this preferred embodiment, a current control device 609 is used to reduce current crowding that would otherwise occur in the coupling device 612. This current control device 609 interrupts an otherwise straight current path through the coupling device 612. In the working example shown in FIG. 6A, the current control device 609 is a notch 609 formed in the coupling device 612 between the first segment 604 and the second segment 608.

In this working example each segment is approximately 20 microns long and 10 microns wide. This provides a total of approximately four squares, with each square having a resistance of about 29 ohms, resulting in a total resistance of 130 ohms (including the connecting traces). In this exemplary working example, the parasitic resistance is approximately in the range between 7 to 8 percent and is tuned for an ink drop weight of about 5 ng. Alternatively, a resistance of at least 80 ohms would result in a parasitic resistance of approximately 12 percent. The width of the gap 621 between the opposing segment was approximately 3 microns.

A second resistor structure of the present invention is to reduce the thermal resistance of the passivation layer on the thin-film resistor. The present invention accomplishes this by reducing the thickness of the passivation layer to allow a minimum amount of energy to energize the resistor and cause an ink drop to be ejected. Preferably, with the thinner passivation layer, energies less than 1.4 microjoules are required to energize the resistor, with a preferred energy range being 0.8 to 1.0 microjoules. The power required to energize the resistor is also affected by ratio of trace resistance to total resistance (parasitic power loss), and a lower parasitic power loss generally means that less power is required. The present invention preferably utilizes both a low ratio of trace resistance to total resistance (a low parasitic power loss) and a thinner passivation layer.

Figure 6B:
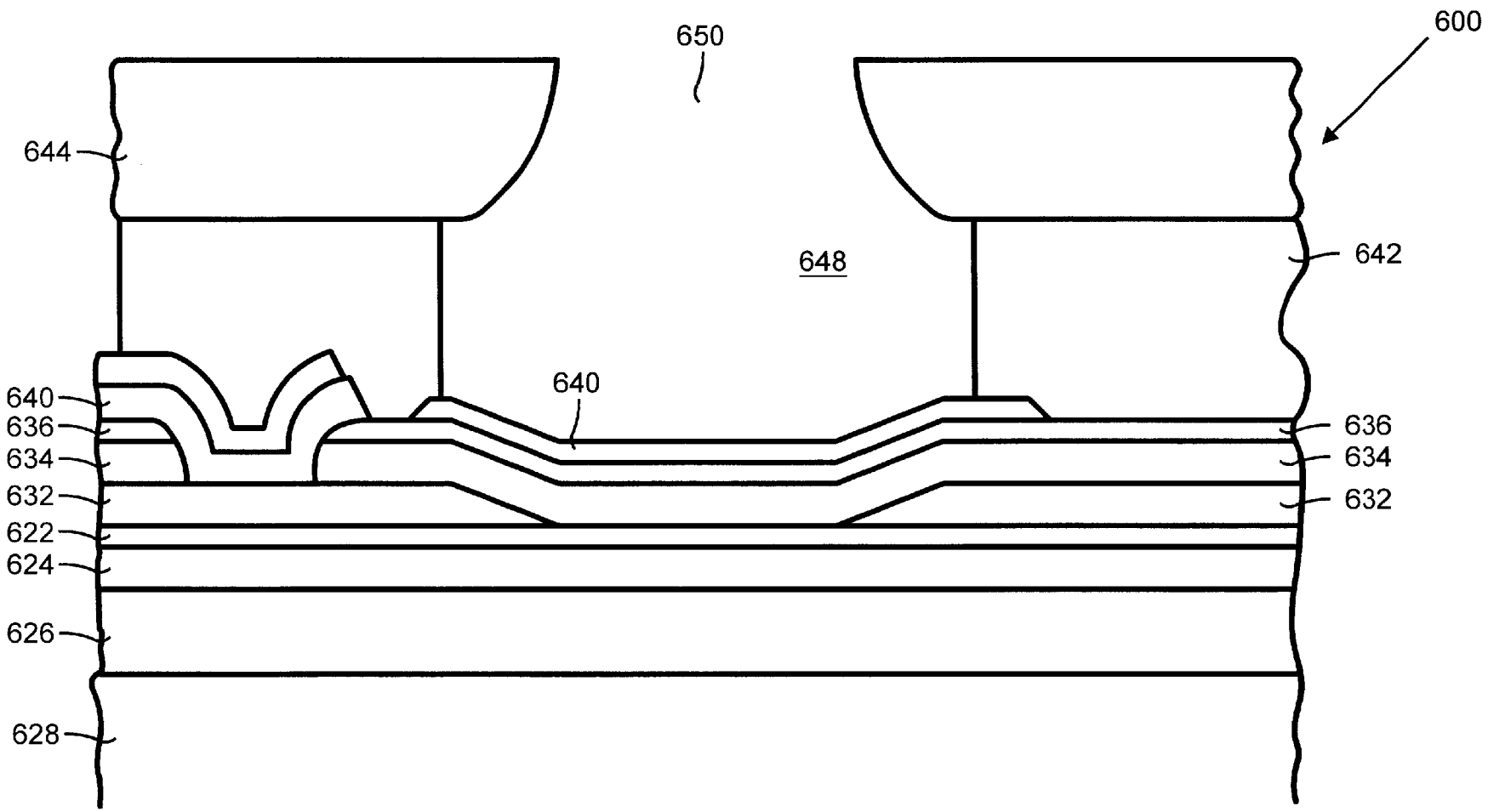
FIG. 6B is a side view of the firing resistor of FIG. 6A showing the thin-film structure of the firing resistor.

FIG. 6B is a side view of the firing resistor of FIG. 6A showing the thin-film structure of the firing resistor. FIG. 6B is a cross-section along AA' from of the resistor 600 shown in FIG. 6A. In this preferred embodiment, the resistor layer 622 is made of Ta Al and overlies a layer of PSG 624 and FOX 626 disposed on a silicon substrate 628. Preferably, the resistor layer 622 is approximately 900 angstroms thick. Overlying a portion of the resistor layer 622 is a conductor layer 632 comprised of AlSiCu.

The resistor layer 622 is protected from damage by a first passivation layer 634 comprised of $Si_3N_4$ and a second passivation layer 636 comprised of SiC. In this working example the thickness of the first passivation layer 634 is 2570 angstroms and the thickness of the second passivation layer 636 is 1280 angstroms. The combination of the first passivation layer 634 and the second passivation layer 636 comprise a total passivation layer. In a preferred embodiment, the total passivation layer is kept to a thickness of less than about 5000 angstroms with a preferred range between about 3500 to 4500 angstroms. At this passivation layer thickness the energy required to energize the resistor layer 622 is less than 1.4 microjoules.

Overlying the second passivation layer 636 is a cavitation layer 640 that protects the resistor layer 622 and passivation layers 634, 636 from damage due to ink drop cavitation and collapse. Preferably, the cavitation layer 640 is comprised of tantalum (Ta) having a thickness of 3000 angstroms. A barrier layer 642 (approximately 14 microns thick) and an orifice layer 644 (approximately 25 microns thick) overlie the cavitation layer 640. The cavitation layer 640, barrier layer 642 and orifice layer 644 create a firing chamber 648 where ink is vaporized by the resistor layer 622 and ejected from a nozzle 650 created by the orifice layer 644.

Overdamped Ink Drop Generators

Maximum firing frequency of the present invention is determined theoretically by how quickly the firing chamber of the ink drop generator refills. A wide entrance from an ink source to the firing chamber provides a faster refill time and increases the firing frequency. However, a sufficiently wide entrance can be underdamped and consequently can have the severe disadvantage of generating widely varying drop ejection characteristics. In particular, with an underdamped system, ink within the firing chamber will slosh or oscillate back and forth between an orifice and the entrance channel after a drop ejection. This oscillation, called "ringing", causes an ink drop volume instability whereby the volume of the ejected ink drops can vary considerably with frequency and sometimes over time. This ink drop volume instability can cause a major degradation of print quality that results in an unpredictable area coverage of the print media during printing or even ink pooling around the firing chamber (known as "puddling"). Puddling can alter the trajectory of ejected drops or even shut down firing chamber operations.

One preferred aspect of the present invention solves this problem by using a printhead architecture that is overdamped. An overdamped printhead has no oscillation and hence has predictable behavior. The overdamped printhead of the present invention utilizes a combination of ink properties along with barrier and orifice geometry to provide a drop generator with a predictable drop volume. This drop volume is constant below a certain critical firing frequency and then slowly decreases above the critical frequency. The overdamped drop generator of the present invention does not exhibit the trajectory or missing drop problems associated with puddling.

Figure 7A:
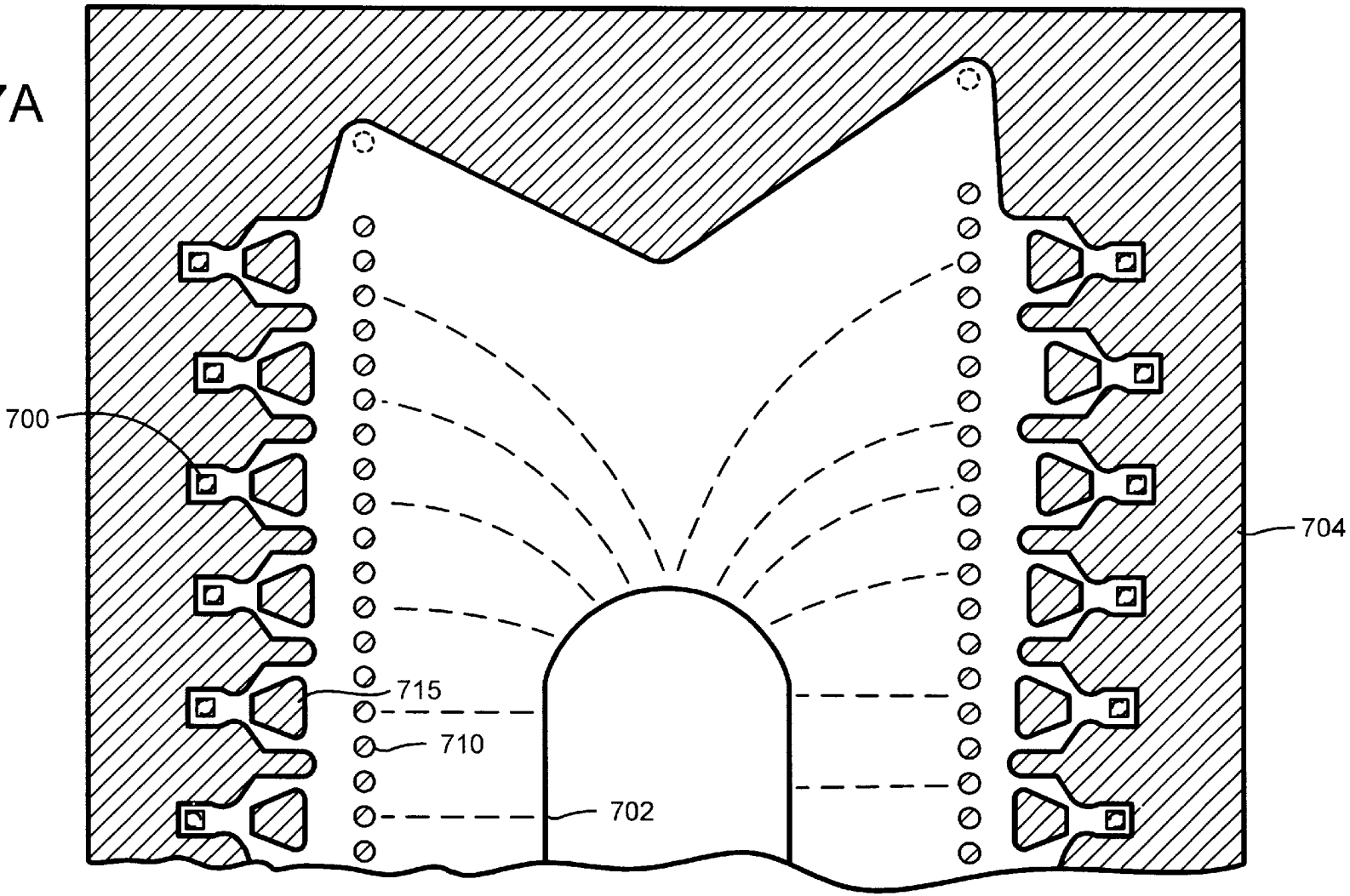
FIG. 7A is a plan view of a single firing chamber of the present invention.
Figure 7B:
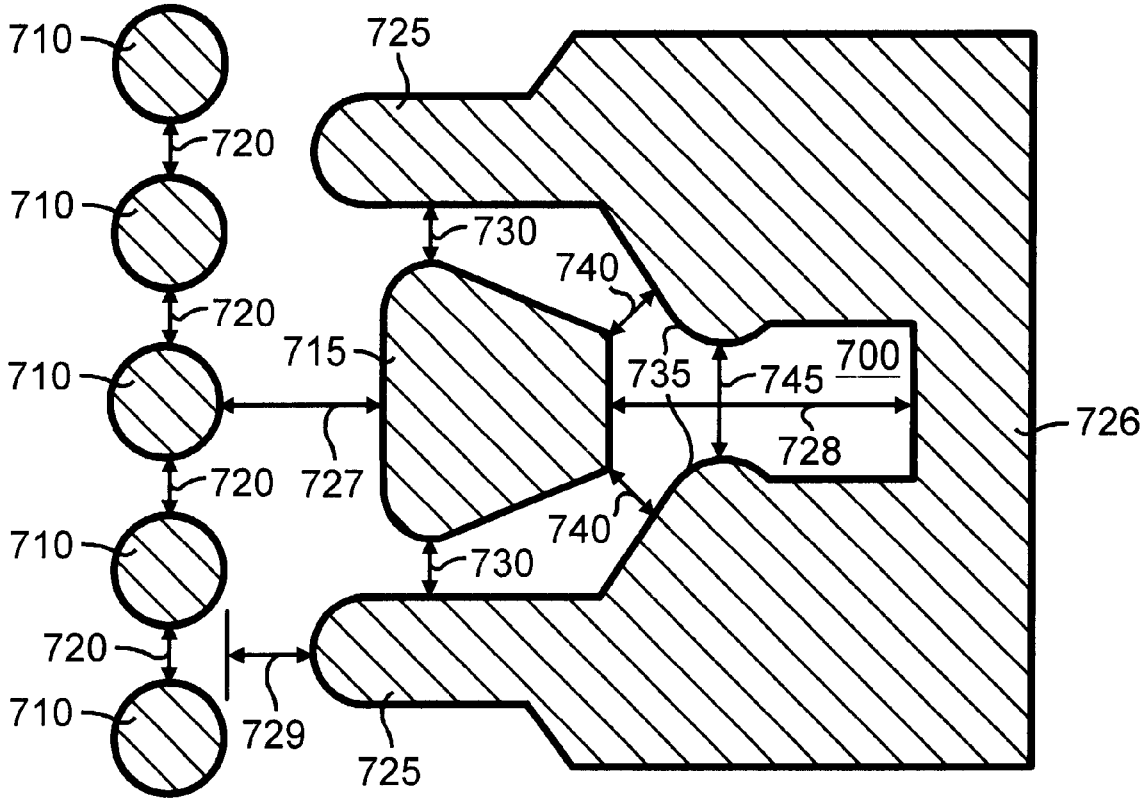
FIG. 7B shows for illustrative purposes a magnified portion of the geometric aspects of a single firing chamber of FIG. 7A.

In an exemplary embodiment, the overdamped structure is formed using at least one constriction (known as a "pinch point") in an entrance channel formed between an ink source and each firing chamber. A working example of a portion of the printhead and a single firing chamber 700 are shown in FIGS. 7A and 7B, respectively, with FIG. 7B showing a magnified portion of FIG. 7A in order to better illustrate geometric aspects of a single firing chamber. Ink flows from a feed slot 702 passing through the substrate 704 past a row of outer barrier features 710, past an inner barrier feature 715 and to the firing chamber 700. The distance between adjacent outer barrier features 710 defines an outer pinch point 720. In this working example the outer pinch point 720 is 10 microns. Moreover, the outer barrier features 710 are circular with a diameter of approximately 18 microns, and other shapes and sizes may be used to form the outer barrier features 710. The inner barrier feature 715 is positioned between peninsulas 725, the outer barrier features 710 and a firing chamber end boundary 726. In this working example, the distance 727 between the outer barrier features 710 and inner barrier feature 715 is approximately 28 microns, while the distance 728 between the inner barrier feature 715 and the firing chamber end boundary 726 is approximately 54 microns. Moreover, the distance 729 between tips of the peninsulas 725 and the outer barrier features 710 in this working example is approximately 21 microns, and this distance 729 can vary.

The distance between the inner barrier feature 715 and the peninsulas 725 defines a first intermediate pinch point 730. In this working example, the first intermediate pinch point 730 is 10 microns. The distance between the inner barrier feature 715 and entrance protrusions 735 defines a second intermediate pinch point 740. In this working example, the second intermediate pinch point 740 is 10 microns. Further, the distance between the entrance protrusions 735 defines an inner pinch point 745 that, in this working example, is 20 microns wide.

The combination of pinch points (the outer pinch point 720, the first intermediate pinch point 730, the second intermediate pinch point 740 and the inner pinch point 745) used in the present invention offers several advantages. In particular, the combination of pinch points, when used with proper ink properties, provides an overdamped drop generator that eliminates ink drop volume instabilities. In this working example, to provide a proper ejected ink drop weight, the orifice is less than 15 microns in diameter and is preferably 12.5 microns with a range of 10 to 15 microns. In this configuration, and with pinch points of 10 microns, particles that would tend to block the orifice are filtered from the ink before they can reach the orifice and possibly shut down firing chamber operations. The outer and inner barrier features 710, 715 provide redundant ink flow paths between a source of ink and the orifice. Further, in order to provide proper damping and filtration, the barrier layer is less than 20 microns thick, and is preferably about 14 microns, with a preferred range of 10 to 18 microns. The proper volume or column of ink above the resistor is provided by employing an orifice layer that is less than 30 microns thick and preferably is approximately 25 microns thick, with a preferred range of 20 to 30 microns thick.

III. Ink Composition

Another aspect of the invention is ensuring that the ink can successfully be used with the high-frequency printing system. One aspect involves alleviating any ink stability caused by decel. Decel occurs during a high-frequency printing burst and decreases the velocity and stability of the ink due to residue on the resistor. The ink instability and loss of ink drop velocity can cause unacceptable variations in the quality of the print.

A preferred embodiment of the present invention uses ink that comprises an aqueous vehicle and a decel-alleviating component. This component is capable of undergoing rapid thermal decomposition when heated to greatly reduce the residue left by the ink during high-frequency printing bursts. Preferably, the decel-alleviating component is a liquid-soluble compound capable of undergoing a rapid, preferably exothermic, thermal decomposition upon heating. Further, the decel-alleviating component preferably includes a salt with a cationic component and an anionic component having reducing or oxidizing capabilities. The decomposition products of the decel-alleviating component are preferably a gas or liquid and not a solid. In a working example of the present invention the decel-alleviating compound is ammonium nitrate added at 1% by weight. Alternatively, other decel-alleviating components may be used (such as $NH_4NO_3$ and $NH_4NO_2$).

In order to achieve a proper level of damping, the viscosity of the ink should be between approximately 2 to 5 centipoise, with a preferred value of 3.2 centipoise.

Further, the surface tension of the ink should be kept between about 20–40 dynes per centimeter, with a preferred value of 29 dynes per centimeter.

Keeping the surface tension and viscosity of the ink within these ranges and using the ink composition discussed above to reduce decel generally ensures that the ink can successfully be used with the high-frequency printing system of the present invention.

The foregoing description of the preferred embodiments of the invention has been presented for the purposes of illustration and description. It is not intended to be exhaustive or to limit the invention to the precise form disclosed. Accordingly, the foregoing description should be regarded as illustrative rather than restrictive, and it should be appreciated that variations may be made in the embodiments described by workers skilled in the art without departing from the scope of the present invention as defined by the following claims.

What is claimed is:

1. A printhead assembly, comprising:

a printhead having a plurality of drop generators; and a fluid source having a decel-alleviating component that enables high frequency printing and a combination of fluid properties that allows the drop generators to eject a predictable drop volume.

2. The printhead assembly of claim 1, further comprising a fluid orifice and wherein at least one drop generator includes barrier features, wherein the geometrical arrangement of the barrier features define redundant flow paths from the fluid source to the fluid orifice.

3. The printhead assembly of claim 1, wherein at least one drop generator further includes barrier features, wherein the barrier features include a plurality of outer barriers disposed in the entrance channel and an a outer pinch point formed by a distance between two adjacent outer barriers.

4. The printhead assembly of claim 3, wherein the distance between two outer barriers is from about 5 microns to about 25 microns.

5. The printhead assembly of claim 4, wherein each of the plurality of outer barriers is circular.

6. The printhead assembly of claim 3, wherein the barrier features include two entrance protrusions disposed within the firing chamber and an inner pinch point formed by a distance between the two entrance protrusions.

7. The printhead assembly of claim 6, wherein the distance between the two entrance protrusions is from about 10 microns to about 40 microns.

8. The printhead assembly of claim 6, wherein the barrier features include a peninsula extending outward from and adjacent the firing chamber an inner barrier adjacent the firing chamber and peninsula and a first intermediate pinch point formed by a distance between the inner barrier and the peninsula.

9. The printhead assembly of claim 8, wherein the distance between the inner barrier and the peninsula is between from about 5 microns to about 25 microns.

10. The printhead assembly of claim 8, wherein the barrier features further comprise a second intermediate pinch point formed by a distance between the inner barrier and one of the entrance protrusions.

11. A printhead, comprising:

a fluid source that provides fluid with a predefined viscosity in the range of 2 to 5 centipoise; and a substrate having a plurality of drop generators, wherein at least one of the drop generators has at least two constrictions that the fluid flows past from the fluid source to the drop generator, wherein the at least two constrictions include a plurality of barrier features defining inner, intermediate, and outer pinch points.

12. The printhead of claim 11, wherein the firing chamber ejects a plurality of ink drops at a high frequency and a predictable ink drop volume that is less than about 8 nanograms.

13. The printhead of claim 12, wherein the high frequency is between from about 12 kilohertz to about 18 kilohertz.

14. The printhead of claim 11, wherein the ink has an additive to reduce or eliminate decel.

15. The printhead of claim 11, wherein the viscosity is approximately 3.2 centipoise.

16. A printhead assembly comprising:

a fluid source having a viscosity in the range of 2–5 centipoise; and an overdamped printhead including a substrate having defined thereon a barrier layer that is less than 20 microns thick, the barrier layer defining at least one constriction that receives the fluid source and creates an overdamped condition of the printhead to enable a predictable drop volume during drop ejection from the printhead.

17. The printhead assembly of claim 16, wherein the barrier layer is 10–18 microns thick.

18. The printhead assembly of claim 16, wherein the barrier layer is approximately 14 microns thick.

19. A high performance printhead assembly, comprising:

a printhead substrate having a plurality of drop generators formed thereon at an area density of at least six drop generators per square millimeter, wherein at least one of the plurality of drop generators emit droplets having a drop volume of less than 8 nanograms;

a fluid source providing fluid to the drop generators, the fluid source having a viscosity in the range of 2 to 5 centipoise.

20. The high performance printhead assembly of claim 19, wherein drop volume is in the range of 3.5 to 6.5 nanograms.

21. The high performance printhead assembly of claim 19, wherein the at least one drop generator includes barrier features such that the fluid flowing from the fluid source to the drop generators passes at least two pinch points.

* * * * *